US006358112B1

(12) United States Patent
Lambert et al.

(10) Patent No.: US 6,358,112 B1
(45) Date of Patent: Mar. 19, 2002

(54) TOY VEHICLE TRACKWAY SET HAVING VEHICLE SNATCHING TOY FIGURE

(75) Inventors: Gerard L. Lambert, Torrance; Gary Swisher, Rolling Hills Estates; David Sheltman, Irvine, all of CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/366,178

(22) Filed: Aug. 3, 1999

(51) Int. Cl.[7] ..... A63H 29/00

(52) U.S. Cl. ..... 446/429; 446/169; 446/444; 238/10 C; 238/10 R

(58) Field of Search ..... 446/429, 444, 446/168, 169, 173, 174, 446, 228, 304, 75, 76, 77; 463/58, 59, 60, 68; 238/10 A, 10 B, 10 C, 10 F

(56) References Cited

U.S. PATENT DOCUMENTS

| | | | |
|---|---|---|---|
| D262,048 | S | 11/1981 | Kato |
| 4,558,867 | A | 12/1985 | Hippely |
| 4,575,350 | A | 3/1986 | Hippely et al. |
| 4,609,363 | A | 9/1986 | Udagawa |
| D289,666 | S | 5/1987 | Udagawa et al. |
| 4,708,685 | A | 11/1987 | Udagawa |
| 4,767,053 | A | 8/1988 | Cook et al. |
| 4,778,433 | A | 10/1988 | McKay et al. |
| 5,299,969 | A | 4/1994 | Zaruba |
| 5,391,106 | A | 2/1995 | Lidert, Jr. |

*Primary Examiner*—Jacob K. Ackun, Jr.
*Assistant Examiner*—Urszula M. Cegielnik
(74) *Attorney, Agent, or Firm*—Roy A. Ekstrand

(57) ABSTRACT

A toy vehicle trackway set includes a launcher and an entrance track coupled to a stunt loop which in turn supports an exit track. Freely rolling toy vehicles are launched from the toy vehicle launcher to traverse the stunt loop and exit via the exit track. A toy vehicle trap configured to generally resemble a fanciful monster or alien is supported upon the stunt loop and includes a bistable pivotally secured head. The head is pivotable between a first stable position in which toy vehicles are able to avoid the trap and traverse the loop and a second capture position in which toy vehicles are diverted from the track loop into the head of the alien or monster. The bistable support of the pivotal head causes the head to move from its non capture position to a capture position when a sufficient amount of energy has been transferred from a toy vehicle traversing the stunt loop to the trap mechanism.

8 Claims, 3 Drawing Sheets

TOY VEHICLE TRACKWAY SET HAVING VEHICLE SNATCHING TOY FIGURE

FIELD OF THE INVENTION

This invention relates generally to toy vehicle trackway and particularly to those which utilize a stunt feature to improve and enhance the amusement and play value of the trackway set.

BACKGROUND OF THE INVENTION

Toy vehicle trackway sets are well known in the art and have enjoyed long term popularity. The result of this long term popularity together with the creativity of practitioners in the toy arts has resulted in the creation of a virtually endless variety of trackway sets. Despite this variation, virtually all toy vehicle trackway sets may be seen to include several basic elements. The first of these elements is the trackway itself which is typically formed to define some sort of travel path and is fabricated having side walls or other structures which confine a toy vehicle to traversing the trackway. The second general element of toy vehicle trackway sets is the toy vehicle itself which has been subject to substantial variation. Thus, toy vehicles have varied from free wheeling unpowered vehicles to toy vehicles which have some source of loco-motion or power. Typical of such toy vehicle power systems are battery powered electric motor driven vehicles, spring motor driven vehicles or inertial motor vehicles. The final element of the basic toy vehicle trackway set may be generally described as a vehicle launcher. In early toy vehicle playsets utilizing free wheeling toy vehicles, a gravity powered launcher or ramp was typically used. Over the years a variety of spring loaded toy vehicle launchers have been provided for free wheeling toy vehicles. For self-powered vehicles, launchers have been provided which may be described as "hold and release" launchers in which the vehicle is somehow restrained as the powering system is energized after which the toy vehicle is released to traverse the trackway.

Early on in the development of toy vehicle trackway sets, practitioners realized that continued popularity of such products required more interest, amusement and play value than is typically provided by the standard toy vehicle trackway set. In response to this need, practitioners endeavored to provide greater excitement in toy vehicle tracksets. These endorsees included faster and more exciting vehicles, more exciting and amusing launcher devices as well as more complex trackways. The latter often took the form of complex curves or loops. A more resent development in vehicle trackway sets has been the inclusion of various devices which may be generally described as "stunts". Such stunt devices have included jump/ramp combinations, various spinning or whirling apparatus operative upon the toy vehicles or interactive items which are supplemental to the toy vehicle trackway set and which interact with the vehicles. Such interactive devices have included various obstacles, gates or swinging ramps which often alter the travel path of the toy vehicles.

For example, U.S. Pat. No. 4,558,867 issued to Hippely sets forth a TOY VEHICLE TRACKWAY SET having a base member defining a circular ramp, a vehicle loop and a straight track segment together with a vehicle receiving net. The trackway is assembled in configuration in which a self-powered toy vehicle traverses the trackway and the loop therein and is launched from the ramp toward the receiving net in a jumping stunt.

U.S. Pat. No. 4,708,685 issued to Udagawa which sets forth TOYS having a trackway playset utilizing a plurality of self-powered toy figures which are capable of traversing the trackway. An animated figure includes a movable head supporting a magnet and is configured to resemble a large dog. Each of the animals traversing the trackway support a cooperating magnet on the upper surface thereof. As each animal ends its travel upon the trackway it is picked up by the large animal figure and returned to the trackway start position.

U.S. Pat. No. 5,299,969 issued to Zaruba sets forth a LOOP FEATURE FOR PROPELLED TOY VEHICLES includes a generally vertically oriented loop having a movable ingress portion and a movable egress portion. A propelled toy vehicle enters the loop upon engaging one surface of the ingress portion. Player operable controls effect movement of the egress portion to permit the propelled toy vehicle to exit the loop. Both moveable portions have a free end and a connected end. The connected end of each movable portion is hingely connected to each end of a fixed arcuate portion. Within the loop, provision is made for propelling the toy vehicle as it continues to go around the loop.

U.S. Pat. No. 4,767,053 issued to Cook et al. sets forth a MULTIFUNCTION TOY STUNT SET which is capable of formation of a loop and ramps for use during play with toy vehicles. To tower members with engaging grooves are mounted on a base and a frame having flexible sheet pieces is positioned between the tower members. A rod at the end of the flexible member may be inserted into the grooves in order to form a loop and ramps.

U.S. Pat. No. 4,575,350 issued to Hippely et al. sets forth a TRACK FOR TOY VEHICLES shaped to resemble a snake. The track has a tail end and a head end. The head end forms a mouth while the tail end is joined to a gravity ramp secured to a convenient item such as a table or chair. A toy vehicle is accelerated down the ramp and traverses the trackway which resembles the body of a snake and exits the trackway through the mouth formed in snakes head.

U.S. Pat. No. 4,609,363 issued to Udagawa sets forth a TRACK TOY having a spiral track mounted upon a large figure. The large figure resembles a robot and interacts with a plurality of smaller robots which traverse the track.

U.S. Pat. No. Des.289,666 issued to Udagawa et al. sets forth a TOY TRACKWAY OR SIMILAR ARTICLE having a multiply curved generally spiral track supported by a large ramp tower. The ramp tower includes a continuous belt which raises items from the lowest point of the trackway to the highest point on the trackway. As items traverse the trackway, they are returned to the ramp and thereafter raised to the start position once again.

U.S. Pat. No. Des.262,048 issued to Kato sets forth a TOY TRACKWAY HAVING MOVING ANIMATED COMPONENTS while U.S. Pat. No. 5,391,106 issued to Lidert, Jr. and U.S. Pat. No. 4,778,433 issued to Mc Kay et al. both set forth a toy figure having the ability to extend a tongue or similar element to interact with a toy figure.

While to foregoing described prior art devices have improved the art and in some instances enjoyed commercial success, there remains nonetheless a continuing need in the art for evermore interesting, amusing and entertaining toy vehicle trackway sets.

SUMMARY OF THE INVENTION

Accordingly, it is a general object of the present invention to provide an improved toy vehicle trackway set. It is more particular object of the present invention to provide an improved toy vehicle trackway set which includes an amusing and entertaining stunt feature. It is a still more particular object of the present invention to provide an improved toy vehicle trackway set which utilizes the stunt feature to facilitate a competitive play between two or more players.

In accordance with the present invention there is provided a toy vehicle trackway set comprising: a toy vehicle launcher and a plurality of toy vehicles; an entrance track coupled to the toy vehicle launcher; and a stunt loop having a track loop coupled to the entrance track and a toy vehicle trap supported by the track loop having a pivotable head defining a scoop, the head pivotable between a non capture position in which the toy vehicles pass the head upon the track loop and a capture position in which the toy vehicles are captured by the head.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
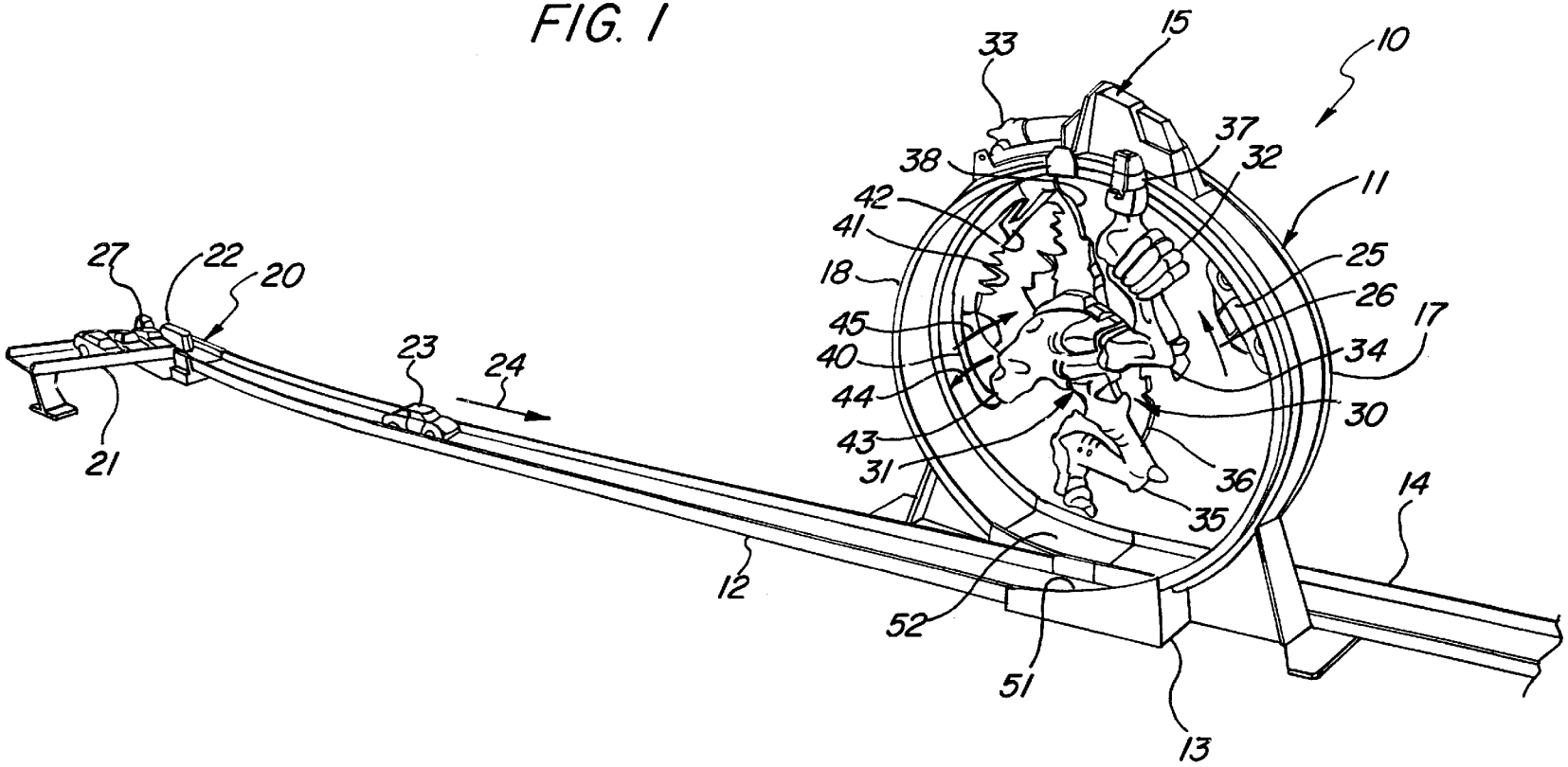
FIG. 1 sets forth a perspective view of a toy vehicle trackway set constructed in accordance with the present invention.

FIG. 1 sets forth a perspective view of a trackway set constructed in accordance with the present invention and generally referenced by numeral 10. Trackway set 10 includes a stunt loop 11 having a base 13 supporting a pair of loop tracks 17 and 18 joined at their upper ends to a trap support 15. Loop tracks 17 and 18 are preferably formed of a flexible plastic material and readily bend into the arcuate shape necessary for forming stunt loop 11. Stunt loop 11 further includes a supporting base 13 which receives the lower ends of loop tracks 17 and 18. Base 13 further defines an entrance ramp 51 joined to loop track 17 and an exit ramp 52 joined to loop track 18. An exit track 14 extends from a ramp 52 while an entrance track 12 is coupled to entrance ramp 51.

A toy vehicle launcher 20 which may be constructed in accordance with conventional fabrication techniques such as the launcher manufactured and sold by Mattel, Inc., El Segundo, Calif. under the trademark "Hot Wheels" and described as a Rapid Fire Launcher. Launcher 20 includes a striker 22 and a launcher magazine 21. A plurality of toy vehicles such as toy vehicle 27 are positioned for successive launches from launcher 20. It will be apparent to those skilled in the art that a variety of toy vehicle launchers may be utilized in the present invention trackway set. The essential function of the launcher used is the acceleration of a toy vehicle down entrance track 12 with sufficient velocity and energy to traverse stunt loop 11 and exit therefrom via exit track 14. Thus, launcher 20 may include a downwardly extending gravity ramp of the type well known in the art or alternatively a spring loaded power launcher such as launcher 20. A toy vehicle 23 is shown accelerated toward stunt loop 11 from launcher 20 along entrance ramp 12 in the direction indicated by arrow 24. In the preferred fabrication of the present invention, a launcher of the type shown is utilized which has the capability of rapidly firing a succession of toy vehicles. A toy vehicle 25 is shown traversing stunt loop 11 in the direction indicated by arrow 26 having been previously fired from launcher 20.

In accordance with the present invention, stunt loop 11 includes a toy vehicle trap 30. It will be noted that toy vehicle trap 30 is shaped to provide an appearance suggestive of a fanciful creature such as an alien monster or the like. It will be equally apparent that trap 30 may be fabricated in accordance with a variety of appearances and themes without departing from the spirit and scope of the present invention. Trap 30 includes a body 31 formed of a pair of body portions 60 and 70 40 in the assembly drawings shown in FIG. 3. Suffice it to note here, that body 31 includes an attachment 37 secured to trap support 15 on one side of loop track 17 together with a claw 33 securing body 31 to trap support 15 on the opposite side of loop track 18. Body 31 includes a claw 32 supported by an arm 34 joined to body 31 together with a pair of legs 35 and 36. Body 31 further includes an arm 38 joined to claw 33. Trap 30 further includes a head 40 pivotally secured to body 31 by a hinge 43. Head 40 is pivotally movable in the directions indicated by arrows 44 and 45. The structure of head 40 is set forth below in greater detail in FIG. 2. However, suffice it to note here, that head 40 includes a scoop 42 and a curved jaw 41. Further, suffice it to note that head 40 is pivotable about hinge 43 in the direction indicated by arrow 45 in which scoop 42 is removed from track loop 18 and is oppositely pivotable in the direction indicated by arrow 44 in which scoop 42 is close to loop track 18. Thus in one position of head 40, trap 30 will capture a toy vehicle such as toy vehicle 25 attempting to traverse the stunt loop. Conversely, in the opposite position scoop 42 is removed from loop track 18 a sufficient distance to allow a toy vehicle such as toy vehicle 25 to pass between head 40 and loop track 18 thereby completing its transit of stunt loop 11 and exiting via track 14. It will be further noted and is described below in greater detail, the balance of hinge 40 is maintained by the position of head 43 such that head 40 is marginally stable in the pivotal position indicated by arrow 45. Thus, slight disturbances of stunt loop 11 cause head 40 to move in the direction indicated by arrow 44. This forms an important aspect of the play pattern of the present invention trackway set.

In operation, head 40 is initially pivoted in the direction indicated by arrow 45 which allows a toy vehicle to complete its transit of stunt loop 11. Thereafter, the child or in the event of multiple players children utilize launcher 20 to launch one or more toy vehicles down track 12 into stunt loop 11. As a toy vehicle encounters stunt loop 11 the energy thereof imparts a certain amount of energy to stunt loop 11 disturbing its position slightly. The degree of disturbance is determined by the vehicle velocity and its mass. As children become more skilled in utilizing the present invention trackway set, they are able to choose whether or not the particular toy vehicle they launch toward stunt loop 11 disturbs head 40 or simply passes through leaving head 40 in its clearance position. If sufficient energy is supplied to stunt loop 11 to disturb head 40, head 40 pivots in the direction indicated by arrow 44. As a result, the next car subsequently launched will be captured by scoop 42. One potential play pattern is provided as child users take turns launching vehicles from launcher 20 with the objective being the skillful avoidance of triggering the pivotal movement of head 40. Alternatively, the objective may be to trigger head 40 to its trapping position in order to cause the trapping of the opposing players next launched toy vehicle. In the preferred operation of trap 30, a toy vehicle transferring sufficient energy to stunt loop 11 to trigger the pivotal movement of head 40 to its trapping position (in the direction indicated by arrow 44) is able to traverse loop track 17 and loop track 18 and avoid head 40. As a result, a toy vehicle triggering the trapping action of trap 30 is not itself trapped but rather positions trap 30 in the capture position for the next toy vehicle traversing stunt loop 11.

Figure 2:
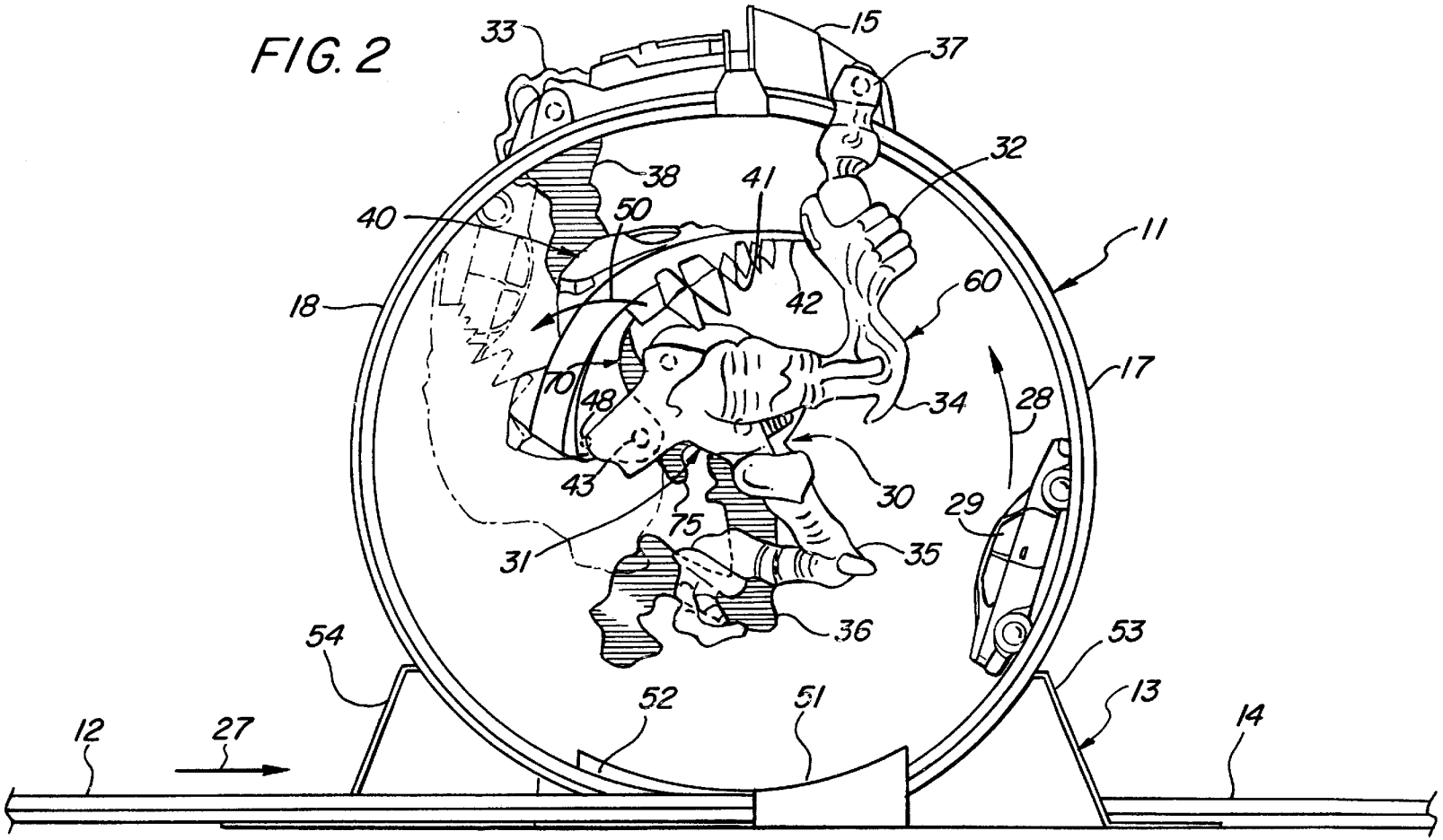
FIG. 2 sets forth a side elevation view of the stunt feature of the present invention toy vehicle trackway set.

FIG. 2 sets forth a side elevation view of stunt loop 11. Stunt loop 11 shows trap 30 in the cocked position in which a toy vehicle is able to traverse the stunt loop without being captured by trap 30.

More specifically, stunt loop 11 includes a base 13 preferably formed of a molded plastic material or the like having an entrance ramp 51 supported by a strut 53 and coupled to an entrance track 12. Base 13 further includes an exit ramp 52 supported by a strut 54 and coupled to an exit track 14. A loop track 17 is coupled to ramp 51 while a loop 18 is coupled to ramp 52. Loop tracks 17 and 18 are preferably formed of a resilient material such as molded plastic or the like and are thus bent to arcuate shapes and are joined to trap support 15. The attachment of entrance track 12, exit track 14, loop track 17 and loop track 18 are provided by conventional track attachment mechanism (not shown).

In accordance with the present invention, stunt loop 11 includes a trap 30 having a body 31. Body 31 is formed of a pair of body portions 60 and 70 together with a head 40 assembled in the manner shown below in FIG. 3. Suffice it to note here, that body 31 includes an arm 34 having a claw 32 and an attachment 37 joined thereto. Body 31 further includes downwardly extending legs 35 and 36 together with an arm 38. Arm 38 in turn defines a claw 33. By means set forth below in FIG. 4 in greater detail, attachment 37 and claw 33 are secured to trap support 15. Thus, trap 30 is entirely supported upon trap support 15 by attachment 37 and claw 33. Trap 30 further includes a head 40 having a jaw 41 and a scoop 42 pivotally secured to body portions 60 and 70 by a hinge 43 in the manner set forth below in FIG. 3 in greater detail.

In operation, a toy vehicle such as toy vehicle 29 is accelerated into stunt loop 11 via entrance track 12 in the direction indicated by arrow 27. After passing across ramp 51, toy vehicle 29 continues under its own momentum and curves upwardly in the direction indicated by arrow 28 upon loop track 17. With head 40 in the cocked position shown in FIG. 2, toy vehicle 29 is able to continue past trap support 15 and loop track 18 across ramp 52 and outwardly via exit track 14. In accordance with the anticipated game play, the mass and velocity of toy vehicle 29 as it enters and traverses stunt loop 11 determines whether head 40 is disturbed from the cocked position shown in FIG. 2 by a sufficient amount to pivot in the direction indicated by arrow 50 about hinge 43. Should this pivoting of head 40 occur, head 40 assumes the position shown in phantom line depiction in FIG. 2. Also shown in FIG. 2, is the trapping of a toy vehicle which has entered stunt loop 11 following the pivoting of head 40 to its capture position. Thus, a succession of cars is able to traverse stunt loop 11 so long as the energy they impart to stunt loop 11 does not disturb head 40 by a sufficient amount to cause it to flip to the capture position. In the preferred fabrication of the present invention, the position of head 40 with respect to hinge 43 is selected to assure that head 40 is close to the position at which the weight of head 40 passes "over-center" with respect to hinge 43 making the support of head 40 in the non capture position shown in solid line in FIG. 2, a relatively delicate and easily disturbed configuration. When head 40 pivots about hinge 43 to its capture position, a stop tab 75 formed on body portion 70 cooperates with a stop 48 to limit the capture position of head 40. Thus, head 40 is essentially a "bistable" mechanism which is stable either in the non capture position shown in solid line representation in FIG. 2 or in the capture position shown in phantom representation in FIG. 2 but is unstable at any position therebetween. This assures that head 40 will either assume the non capture position or the capture position and will not remain at any position therebetween.

Figure 3:
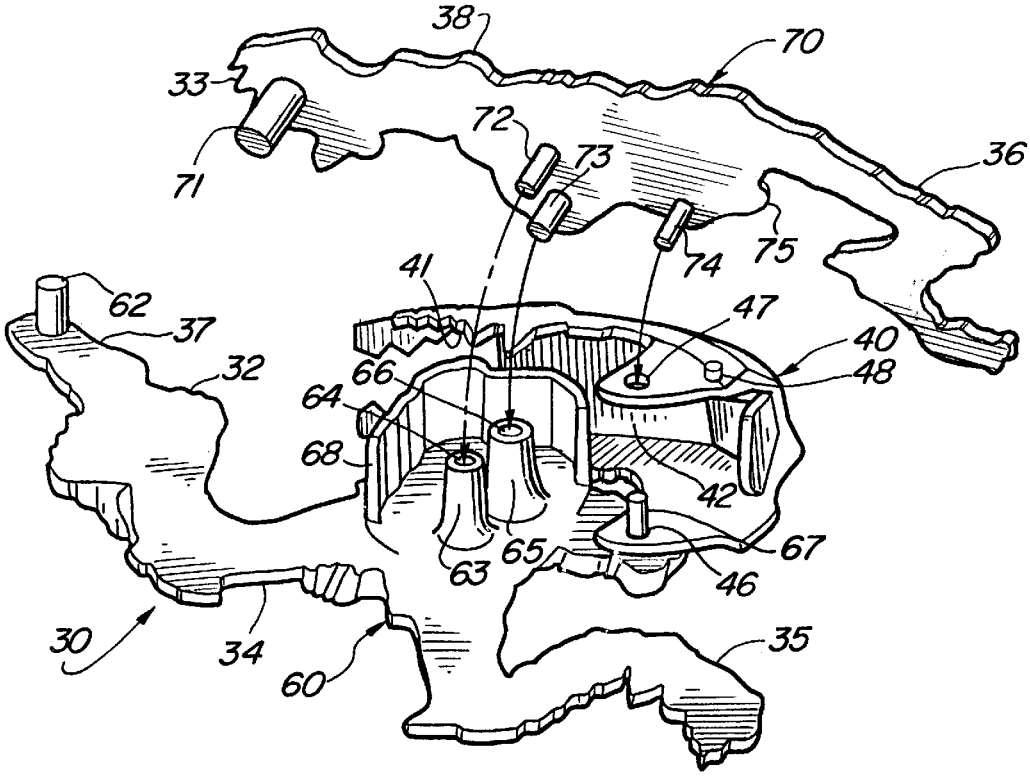
FIG. 3 sets forth a perspective assembly view of the vehicle snatching toy figure of the present invention toy vehicle trackway set.

FIG. 3 sets forth a perspective assembly view of trap 30. As mentioned above, trap 30 is fabricated of three major components which are secured to trap support 15 (seen in FIG. 4). Thus, trap 30 includes a body portion 60 having an attachment 37 and a claw 32 extending from an arm 34. Body portion 60 further includes a leg 35 and an upwardly extending fence 68. Body portion 60 further includes a pair of extending posts 62 and 67 together with a pair of generally cylindrical bosses 63 and 65. Bosses 63 and 65 define respective bores 64 and 66.

A head 40 defines a pair of apertures 46 and 47 together with a jaw 41 and a scoop 42. Aperture 46 is received upon post 67 during the assembly of trap 30.

A body portion 70 includes a claw 33 supported by a arm 38 and a leg 36. Body portion 70 further includes a plurality of extending posts 72, 73 and 74 together with a stop tab 75. Head 40 further includes a stop 48 which cooperates with stop tab 75 to limit the pivotal position of head 40 with respect to body portion 70 in the capture position shown in phantom depiction in FIG. 2. Body portion 70 further includes a post 71 extending from the under side of claw 33.

Trap 30 is assembled by positioning head 40 upon body portion 60 in the manner shown such that post 67 is received within aperture 46. Thereafter, body portion 70 is assembled to body portion 60 by insertion of posts 72 and 73 into bores 64 and 66 respectively of bosses 63 and 65. Correspondingly, the assembly of body portion 70 to body portion 60 passes post 74 through aperture 47 of head 40 completing the hinge attachment between head 40 and body portions 60 and 70. Fence 68 cooperates with scoop 42 in the capture of a toy vehicle as set forth above in FIG. 2. When thus assembled, trap 30 may be joined to trap support 15 of stunt loop 11 in the manner set forth below in FIG. 4.

Figure 4:
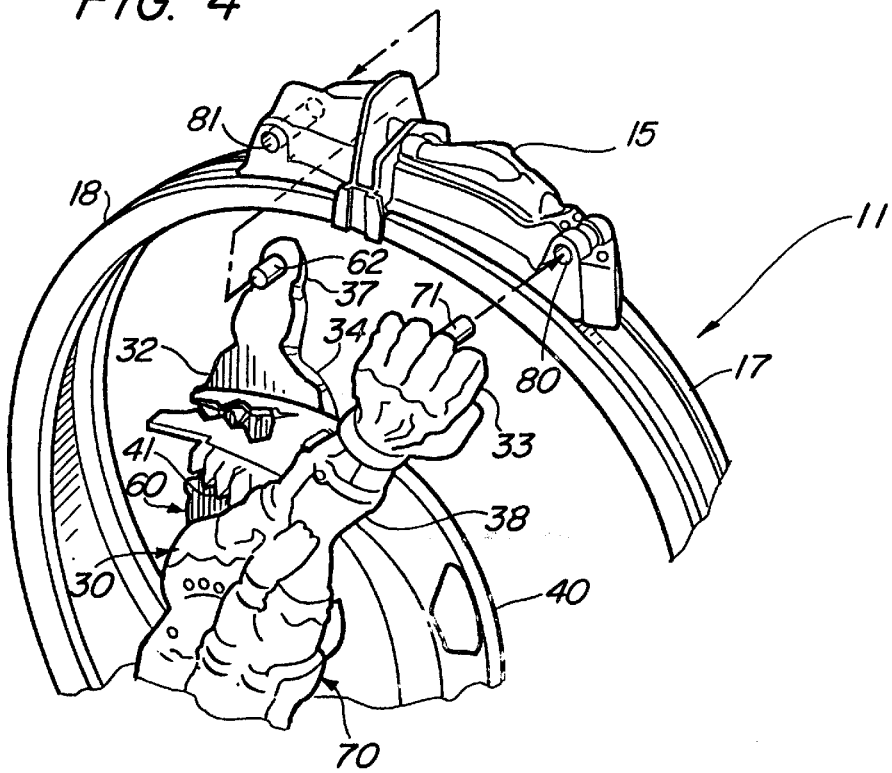
FIG. 4 sets forth a partial perspective assembly view showing the assembly of the vehicle snatching toy figure to the trackway.

FIG. 4 sets forth a partial perspective assembly view of stunt loop 11 showing the attachment of trap 30 to trap support 15. As described above, trap support 15 joins loop track 17 to loop track 18 using conventional attachment (not shown). Trap support 15 further defines a pair of bores 80 and 81. Trap 30 having been assembled in the manner described above in FIG. 3, includes body portions 60 and 70 having arms 34 and 38 supporting attachment 37 and claw 33 respectively. Head 40 having jaw 41 is pivotally supported between body portions 60 and 70 as described above in FIG. 3. Attachment 37 includes a post 62 receivable within bore 81 of trap support 15 while claw 33 includes a post 71 receivable within bore 80 of trap support 15. For stable assembly, post 62 and post 71 enter trap support 15 from opposite sides thereof. Once attachment 37 and claw 33 are fully secured to trap support 15, the assembly of stunt loop 11 is complete.

What has been shown is a novel toy vehicle trackway set having a capture feature which performs in a novel manner and which is presented in an aesthetically pleasing and exciting manner. The capture of a toy vehicle traversing the stunt loop is provided by a trap having a pivotally secured head which moves to a capture position in a relatively unpredictable manner. Thus, the conventional toy trackway play pattern is enhanced by the additional aspect of impact or energy consideration to be made with the desire to either trigger a vehicle capture or avoid it on any given toy vehicle launch.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle trackway set comprising:

a toy vehicle launcher and a plurality of toy vehicles;

an entrance track coupled to said toy vehicle launcher; and a stunt loop having a track loop coupled to said entrance track and a toy vehicle trap supported by said track loop having a pivotable head defining a scoop, said head pivotable between a non capture position in which said toy vehicles pass said head upon said track loop and a capture position in which said toy vehicles are captured by said head and held within said scoop removed from said stunt loop.

2. The toy vehicle trackway set set forth in claim 1 wherein said toy vehicle trap includes:

a body having a pair of arms supporting said toy vehicle trap within said track loop; and a hinge pivotally supporting said head upon said body.

3. A toy vehicle trackway set comprising:

a toy vehicle track having a vertical loop formed therein;

first and second toy vehicles;

a toy vehicle launcher coupled to said track for successively launching said first and second toy vehicles onto said track and through said loop; and a toy vehicle trap having a body supported within said loop and a head, pivotally joined to said body, defining a scoop for capturing a toy vehicle, said scoop of said head being between a first non capture position in which said scoop is spaced from said loop a sufficient distance to allow said toy vehicle to pass said scoop and being disturbed and pivoted by the disturbance produced by the passing of said first toy vehicle traversing said loop to a second capture position in which said scoop captures and holds said second toy vehicle traversing said loop after said first toy vehicle.

4. The toy vehicle trackway set set forth in claim 3 wherein said body includes a pair of arms joined to said loop and wherein said body hangs from said arms.

5. The toy vehicle trackway set set forth in claim 4 wherein said head generally resembles a creature head and wherein said scoop defines a curved surface and a cavity within said head.

6. The toy vehicle trackway set set forth in claim 5 wherein said loop includes:

a base having an entrance ramp and an exit ramp;

a pair of curved tracks having first ends coupled to said exit ramp and said entrance ramp and second ends; and a trap support joined to said second ends to form said loop.

7. The toy vehicle trackway set forth in claim 6 wherein said arms are joined to said trap support.

8. The toy vehicle trackway set set forth in claim 7 wherein said head is bistable and defines a bistable characteristic between said first and second positions and is stable in either said first or second positions while being generally unstable therebetween.

* * * * *